US011345493B2

(12) United States Patent
Cere'

(10) Patent No.: US 11,345,493 B2
(45) Date of Patent: May 31, 2022

(54) METHOD AND MACHINE FOR WRAPPING A LOAD WITH FILM

(71) Applicant: AETNA GROUP S.P.A., Verucchio (IT)

(72) Inventor: Mauro Cere', Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 205 days.

(21) Appl. No.: 16/632,048

(22) PCT Filed: Jul. 19, 2018

(86) PCT No.: PCT/IB2018/055383
§ 371 (c)(1),
(2) Date: Jan. 17, 2020

(87) PCT Pub. No.: WO2019/016752
PCT Pub. Date: Jan. 24, 2019

(65) Prior Publication Data

US 2020/0231312 A1 Jul. 23, 2020

(30) Foreign Application Priority Data

Jul. 20, 2017 (IT) ..... 102017000082727

(51) Int. Cl.
*B65B 57/04* (2006.01)
*B65B 11/02* (2006.01)
(Continued)

(52) U.S. Cl.
CPC ..... *B65B 11/025* (2013.01); *B65B 41/16* (2013.01); *B65B 57/04* (2013.01); *B65B 2011/002* (2013.01)

(58) Field of Classification Search
USPC ..... 53/461
See application file for complete search history.

(56) References Cited

U.S. PATENT DOCUMENTS 4,458,467 A 7/1984 Shulman et al.
5,123,230 A 6/1992 Upmann
(Continued)

FOREIGN PATENT DOCUMENTS

CN 104203753 12/2014
CN 105644821 6/2016
(Continued)

OTHER PUBLICATIONS

International Search Report dated Sep. 26, 2018 in International (PCT) Application No. PCT/IB2018/055383.

*Primary Examiner* — Chinyere J Rushing-Tucker
(74) *Attorney, Agent, or Firm* — Wenderoth, Lind & Ponack, L.L.P.

(57) ABSTRACT

A method for wrapping a load with a film uses a wrapping machine. The wrapping machine is provided with an unwinding apparatus including pre-stretching rollers, a return roller and a force sensor to measure a wrapping force of the film. The method includes rotating the unwinding apparatus and the load relative to one another with a rotation speed and unwinding the film, measuring an effective wrapping force of the film, filtering the effective wrapping force by a first filter, to obtain a filtered wrapping force, and calculating by a PID control algorithm an instant film length to be supplied per rotation based on the filtered wrapping force. The method also includes filtering the instant film length by a second filter, calculating an instant rotation speed of one pre-stretching roller based on the instant filtered film length and the rotation speed, and rotating the pre-stretching roller with the instant rotation speed.

13 Claims, 3 Drawing Sheets

(51) Int. Cl.
*B65B 41/16* (2006.01)
*B65B 11/00* (2006.01)

(56) References Cited

U.S. PATENT DOCUMENTS

| | | | |
|---|---|---|---|
| 5,829,234 | A | 11/1998 | Suolahti |
| 10,144,542 | B2 | 12/2018 | Messersi' |
| 2011/0146203 | A1 | 6/2011 | Lancaster, III et al. |
| 2015/0047301 | A1 | 2/2015 | Messersi' |
| 2016/0096645 | A1* | 4/2016 | Lancaster, III ..... B65B 59/001 53/461 |

FOREIGN PATENT DOCUMENTS

| | | |
|---|---|---|
| DE | 31 50 627 | 10/1982 |
| EP | 0 825 112 | 2/1998 |
| WO | 2015/036807 | 3/2015 |

* cited by examiner

Fig. 2
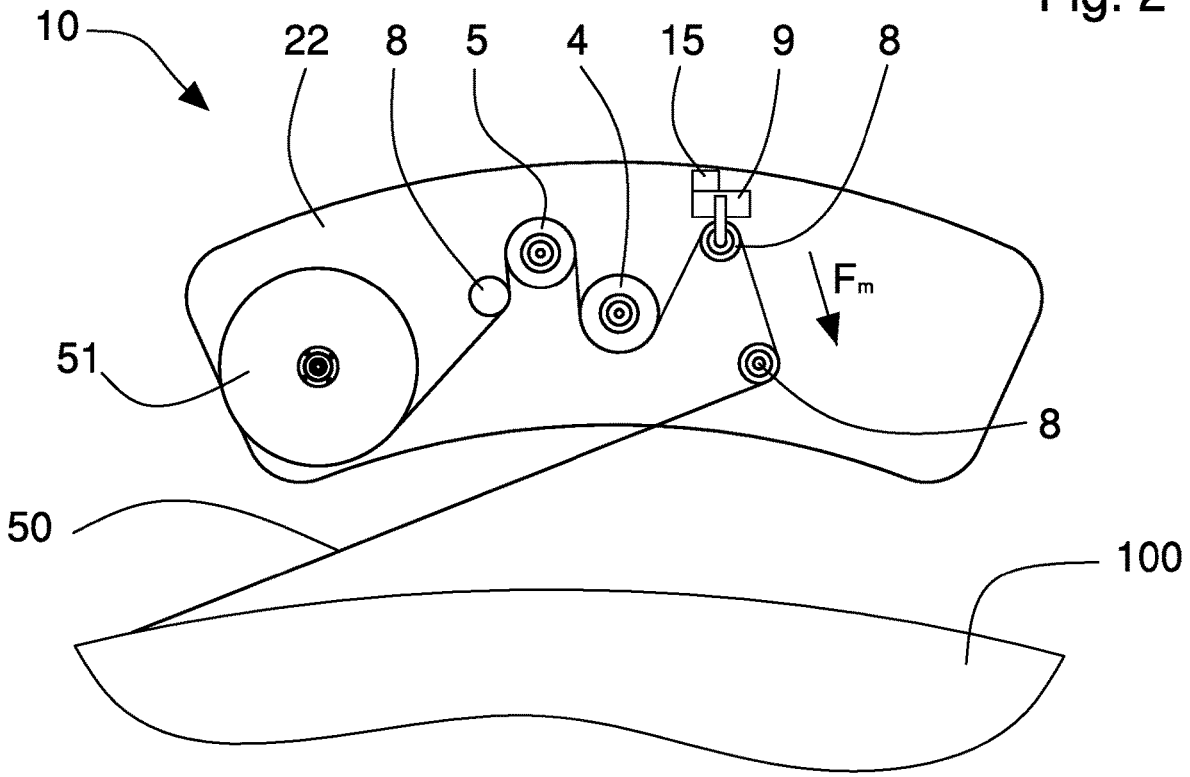
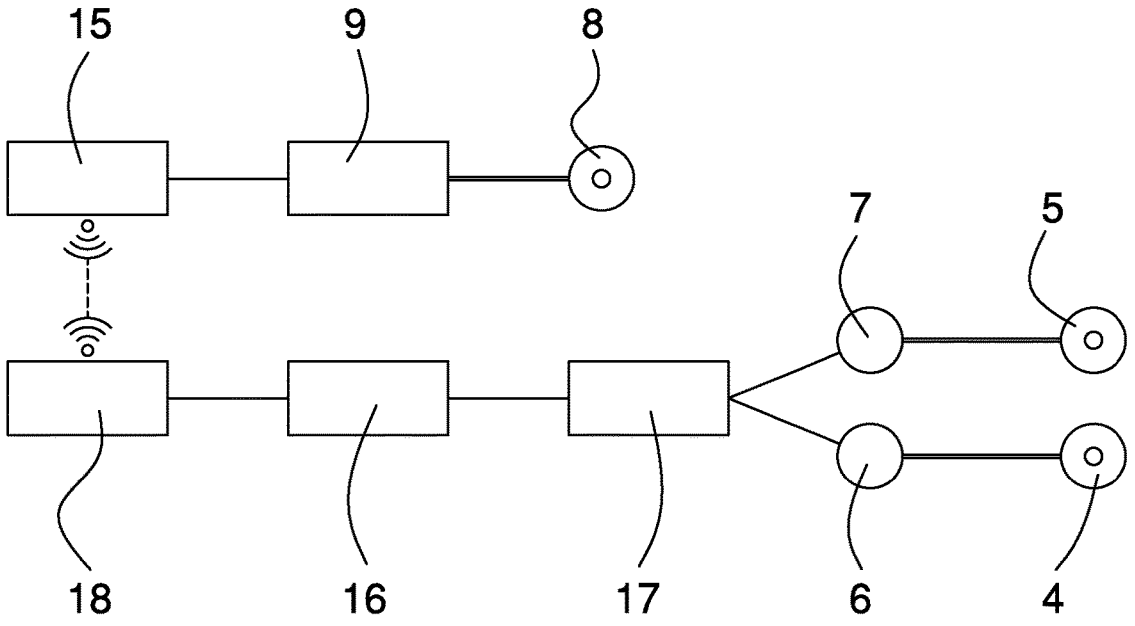
Fig. 3

METHOD AND MACHINE FOR WRAPPING A LOAD WITH FILM

The invention relates to machines and methods for wrapping a load with plastic film or sheet, in particular cold-stretchable ones. In particular, the invention relates to a method for controlling and adjusting the wrapping of film around a load in a wrapping machine, and to a wrapping machine which implements this wrapping method.

The known wrapping machines comprise an unwinding apparatus that supports a reel from which the film is unwound to be wrapped around the load in such a way as to form a series of straps or bands having a helical arrangement, thanks to the combination of the relative linear and rotational movements between the unwinding apparatus and the load, the latter typically formed by one or more products, for example grouped on a pallet or palette.

In wrapping machines provided with a rotary table for supporting the load, the latter is rotated about a vertical wrapping axis, while the unwinding apparatus is vertically moved with reciprocated motion along a fixed column of the machine.

In wrapping machines provided with a horizontal rotating ring or a rotating arm, the load remains fixed during wrapping, while the unwinding apparatus is moved with respect to the latter both by rotating about a vertical wrapping axis and moving in a parallel direction across the latter. For this purpose, the unwinding apparatus is fixed to a ring structure or to an arm rotatably supported by the frame of the machine so as to rotate around the load.

In particular, in horizontal ring wrapping machines the unwinding apparatus is fixed to the ring structure, or rotating ring, which is rotatably supported by a moving frame or carriage so as to rotate about a vertical wrapping axis. The moving carriage is in turn slidably mounted on a fixed frame of the wrapping machine so as to move parallel to the vertical wrapping axis. In wrapping machines with a rotating arm the wrapping apparatus is slidably fixed to the arm in such a way as to be moved linearly along the latter, parallel to the wrapping axis. In doing so, in both types of machines, the film unwinding apparatus is movable along, and about, the wrapping axis while the load to be wrapped remains fixed.

In vertical ring wrapping machines, the load is moved horizontally through the rotating ring, while the unwinding apparatus rotates with the latter about a horizontal wrapping axis. In this case, the rotating ring is rotatably supported by the main frame fixed to the wrapping machine.

The unwinding apparatus is generally provided with a couple of pre-stretching rollers, comprising a slow roller and a fast roller, respectively upstream and downstream with reference to the movement of the film, in order to stretch and unwind the stretchable film, and one or more diverting or return rollers to divert the film toward the load during the unwinding.

By suitably adjusting the difference between the rotation speed of the two pre-stretching rollers, it is thus possible to stretch or lengthen of a defined quantity, according to a determined percentage of pre-stretching or elongation, the film in output from the unwinding apparatus before it is wrapped around the load, to make best use of the film available and to change the mechanical characteristics of the material of the film itself, in relation to the product to be wrapped. By adjusting the rotation speed of the pre-stretching rollers, it is also possible to vary the film unwinding speed from the reel or the speed with which the film exits the unwinding apparatus.

The unwinding apparatus generally comprises an electric motor capable of rotating one of the two pre-stretching rollers that acts as a drive roller (master) (typically the fast roller) and which actuates, through a mechanical transmission group, the other pre-stretching roller that acts as a driven roller (slave), typically the slow roller. In this way, a transmission ratio is fixed between the fast roller and the slow roller on the basis of the pre-stretching or elongation that must be applied to the film.

There are also known unwinding apparatuses provided with a couple of electric motors arranged to operate the two pre-stretching rollers separately and independently, so as to make it possible to vary the elongation of the film, that is, the percentage of pre-stretching or elongation, even during the wrapping of the load.

In the operation of wrapping machines, it is known that it is difficult to maintain a constant force or wrapping tension of the film around the load during the wrapping in order to ensure a value of said wrapping force which is suitable and appropriate for the type of load to be wrapped. The need to control and limit the wrapping force in order to avoid breaking the film is also known.

In fact, the wrapping force varies for each rotation of wrapping in relation to the size, shape or cross section of the load to be wrapped, its position with respect to the wrapping axis, i.e. the relative angular position between the load and the unwinding apparatus. The variations in wrapping force can also be considerably marked, especially in the case of loads with narrow and long sections or wide and short sections.

There are known wrapping machines and methods which envisage maintaining the wrapping force almost constant by suitably varying the speed at which the film unwraps, i.e. its output speed from the unwinding apparatus through the feedback control of the pre-stretching rollers' rotation speed.

There are sensors provided for this purpose (e.g. angular position sensors associated with dancer rollers, encoders mounted on return rollers, torque sensors mounted on motors) which are able to directly or indirectly measure the force of the film and send a signal to a control unit of the wrapping machine, said control unit being able to intervene on the motor or motors of the pre-stretching rollers to increase or decrease their rotation speed.

These feedback control systems, in addition to being expensive and difficult to adjust and fine-tune, are not always able to ensure precise adjustment and accurate wrapping force. In fact, in the feedback control of the pre-stretching rollers' speed, these control systems generally do not take into account the relative rotational speed between the unwinding apparatus and the load about the vertical wrapping axis. However, the rotation speed of the unwinding apparatus also significantly affects the tension of the film during wrapping.

In addition, in the case of high-performance wrapping machines, due to the high rotation speeds of the unwinding apparatus, the known control systems do not allow effective and timely feedback adjustment of the speed at which the film unwraps from the reel in relation to the variations of the tension or force of the film wrapping.

This drawback is even more marked and evident in the case of ring wrapping machines with a motor or motors that actuate the pre-stretching rollers mounted on the frame and not on the unwinding apparatus. In this case, the motion transmission means needed to connect the motor to one of the pre-stretching rollers, due to their length and complexity, create a further delay in the feedback control of the pre-stretching rollers, such as to render the system unsuitable for operation at high rotation speeds of the ring and the unwinding apparatus.

There are known wrapping machines and methods which envisage controlling the speed of the unwinding of the film and/or the quantity of film to unwind per each rotation of the unwinding apparatus around the load or vice versa depending on the size of the latter.

U.S. Pat. No. 5,123,230 describes a vertical ring wrapping machine wherein the adjustment and control of the rotation speed of a roller for the unwinding of the film is envisaged, in order to maintain a desired wrapping tension of the film around the load, on the basis of a sequence of values calculated by a control unit of the machine starting from the size of the load itself.

These wrapping machines and the related wrapping methods do not however ensure satisfactory quality in the wrapping of the film for any rotation speed of the unwinding apparatus around the load. In particular, they do not guarantee a constant wrapping tension of the film around the load at any rotation speed. Furthermore, when unwinding a predefined quantity of film for each rotation, variations in wrapping tension are detected between the band or bands of film wrapped with helical motion in the central portion of the load and those wrapped with circular motion in the portions of the upper and lower ends of the load. In order to stabilise the load and consolidate the wrapping, it is in fact known to wrap said end portions with a plurality of bands of superimposed film.

If the predefined amount of film is such as to ensure correct tension of the film in the end portions, the wrapping tension in the central portion can be high and lead to an excessive contraction of the height of the film with a consequent increase in the consumption of the latter. Vice versa, if the wrapping tension in the central portion is correct, the wrapping tension in the end portions may be insufficient, leading to a loosening of the bands.

In addition, for the correct wrapping of the load it is necessary to precisely know the shape and size and that the same is adjusted (i.e. no protrusions are present) and centred with respect to the wrapping axis.

An object of the invention is to improve the known methods for wrapping a load with a film of plastic material in wrapping machines.

Another object is to provide a wrapping method which makes it possible to monitor and maintain a substantially constant force of wrapping of the film wrapped around the load even for high rotation speeds of a film unwinding apparatus with respect to the load and/or independently from the size and shape of the load and its position inside the machine.

A further object is to provide a wrapping machine and a wrapping method which ensure high quality in wrapping the film around the product.

In a first aspect of the invention, a method is envisaged for wrapping a load with a wrapping machine according to claim 1.

In a second aspect of the invention, a wrapping machine is envisaged which uses the method of the first aspect and according to claim 11.

The invention can be better understood and implemented with reference to the attached drawings that illustrate an embodiment, by way of non-limiting example, in which:

FIG. 2 is a schematic plan view of a film unwinding apparatus of the wrapping machine in FIG. 1;

FIG. 3 is a block diagram which illustrates components of the wrapping machine in FIG. 1;

Figure 1:
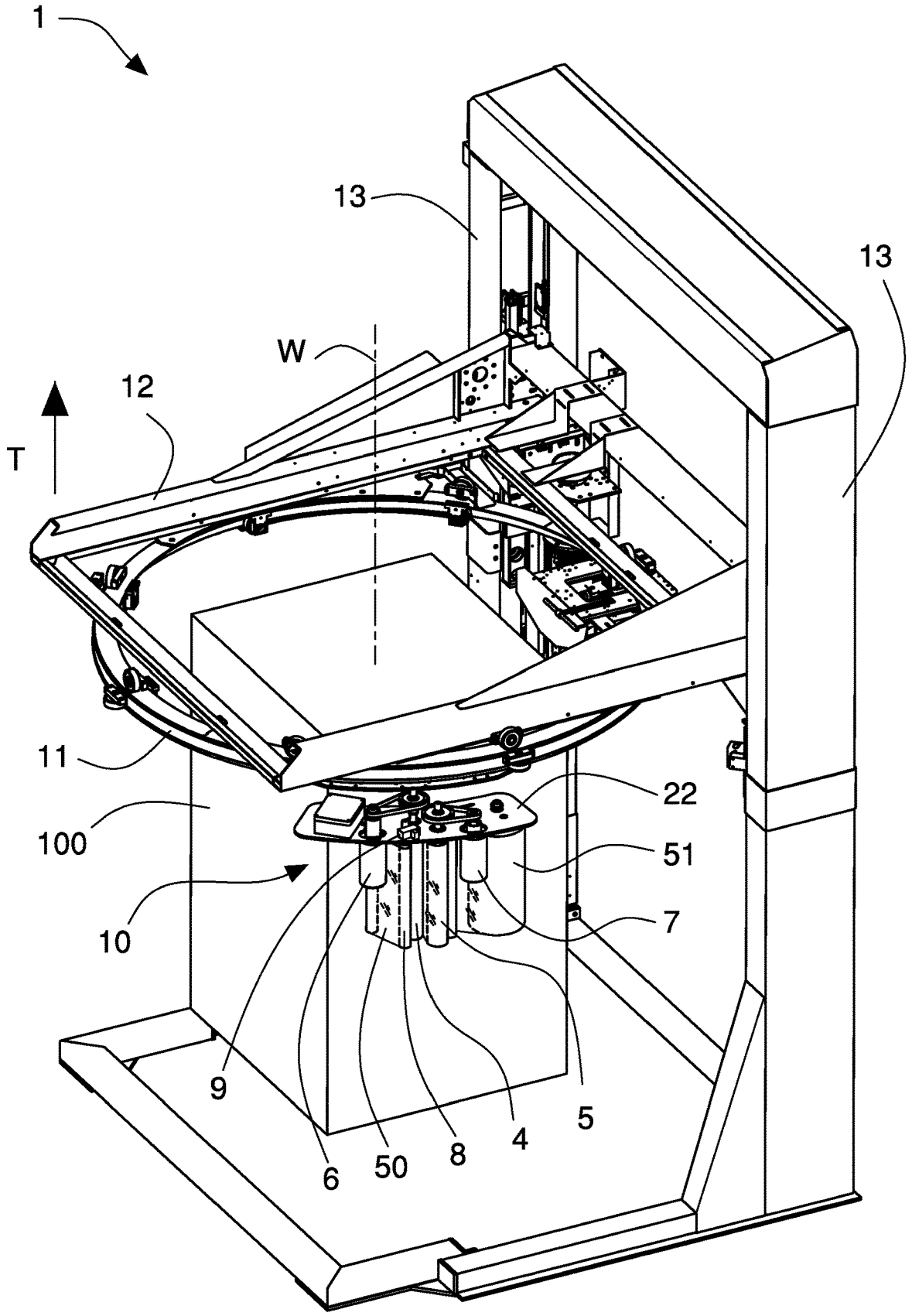
FIG. 1 is a perspective view of a wrapping machine according to the invention and associated with a load to be wrapped.

With reference to FIG. 1, the wrapping machine 1 according to the invention is schematically illustrated, arranged to wrap a product or load 100 with a plastic film 50, in particular a cold-stretchable plastic film.

In the embodiment shown by way of non-limiting example, the wrapping machine 1 comprises a horizontal rotating ring 11, adapted to rotate about a wrapping axis W, substantially vertical, and rotatably supported by a supporting carriage 12 which is linearly movable along a movement direction T substantially parallel to the wrapping axis W. The supporting carriage 12 is slidably supported, for example by a couple of uprights or columns 13.

The wrapping machine 100 is provided with an unwinding apparatus 10 of the film 50 fixed to the rotating ring 11 and comprising a reel 51 of film 50, a couple of pre-stretching rollers 4, 5 for unwinding and stretching the film 50, at least one return roller 8 arranged to divert the film 50 toward the load 100 and at least one force sensor 9 associated with the return roller 8 and arranged to detect a wrapping force of the film 50 that is engaged in said return roller 8 and wrapping around the load 100.

The rotating ring 11 is rotated around the load 100 and the wrapping axis W with a rotation speed Ω, while the supporting carriage 12 is moved along the movement direction T with a linear movement speed $V_r$. In this way, the unwinding apparatus 10 makes it possible to wrap the load 100 and form a series of bands of film 50 with a helical arrangement.

The unwinding apparatus 10 comprises a supporting plate 22 fixed to the rotating ring 11 and arranged for rotatably supporting the reel 51 of film 50, a first pre-stretching roller 4 and a second pre-stretching roller 5 cooperating to unwind and pre-stretch the film 50, a first motor 6 and a second motor 7 respectively coupled to the first pre-stretching roller 4 and to the second pre-stretching roller 5 and intended to separately rotate the latter about respective longitudinal axes. The first pre-stretching roller 4, the so-called fast roller, which in relation to the movement of the film 50 is placed downstream of the second pre-stretching roller 5, the so-called slow roller, rotates faster than the second pre-stretching roller 5 to allow a defined amount or percentage of the film 50 to be stretched or elongated. The first pre-stretching roller 4 is rotated by the first motor 6, for example by means of a respective belt closed in a loop on the pulleys connected to a supporting shaft of the first pre-stretching roller 4 and to the first motor 6. Similarly, the second pre-stretching roller 5 is rotated by the second motor 7, for example by means of a respective belt closed in a loop on the pulleys connected to a respective supporting shaft of the second pre-stretching roller 5 and to the second motor 7.

Alternatively, the pre-stretching rollers 4 and 5 can be actuated or rotated by a respective motor 6, 7 by means of chains, groups of gears and equivalent systems for the transmission of motion.

Still alternatively, the two motors 6, 7 can be mounted on the supporting carriage 12 and actuate the respective pre-stretching rollers 4, 5 by means of transmission means comprising, for example, flexible elements such as belts or chains.

In a further alternative, the unwinding apparatus 10 can comprise a single motor, mounted on the unwinding apparatus 10 itself or on the supporting carriage 12 and actuating one of the two pre-stretching rollers, for example the first pre-stretching fast roller 4, which in turn drives the other pre-stretching roller through a motion transmission/reduction group.

The supporting plate 22 of the unwinding apparatus 10 rotatably supports a plurality of return rollers 8, for example three, arranged to divert the film 50 unwrapped from the reel 51 toward the pre-stretching rollers 4, 5 and toward the load 100.

One of the return rollers 8, for example the one immediately downstream of the first pre-stretching roller 4 with reference to the unwinding direction of the film 50, is mounted on the supporting plate 22 by the interposition of the force sensor 9, which is thus able to measure the wrapping force or tension of the film 50 during the process of wrapping the load 100. A transmission module 15 for wirelessly transmitting data is mounted on the unwinding apparatus 10 and connected to the force sensor 9 to receive from the same the signals relating to the effective wrapping forces $F_m$ measured and sent to a receiving module 18 of a control unit 16 of the wrapping machine 1.

The force sensor 9 comprises, for example, at least one load cell provided with strain gauges or piezoelectric sensitive elements, or a resistive-type force sensor, or other equivalent sensors and devices able to detect and measure a force applied by the film 50 on the return roller 8.

The control unit 16, which comprises, for example, a PLC-type industrial computer or a personal computer PC, is able to manage and control the operation of the entire wrapping machine 1 and in particular to perform the wrapping procedure or method of the invention described below.

The wrapping machine 1 also comprises a driving module 17 connected to and controlled by the control unit 16 and arranged to operate and control the various electric motors and/or actuators of said machine, including the motors 6, 7 that rotate the pre-stretching rollers 4, 5.

Figure 4:
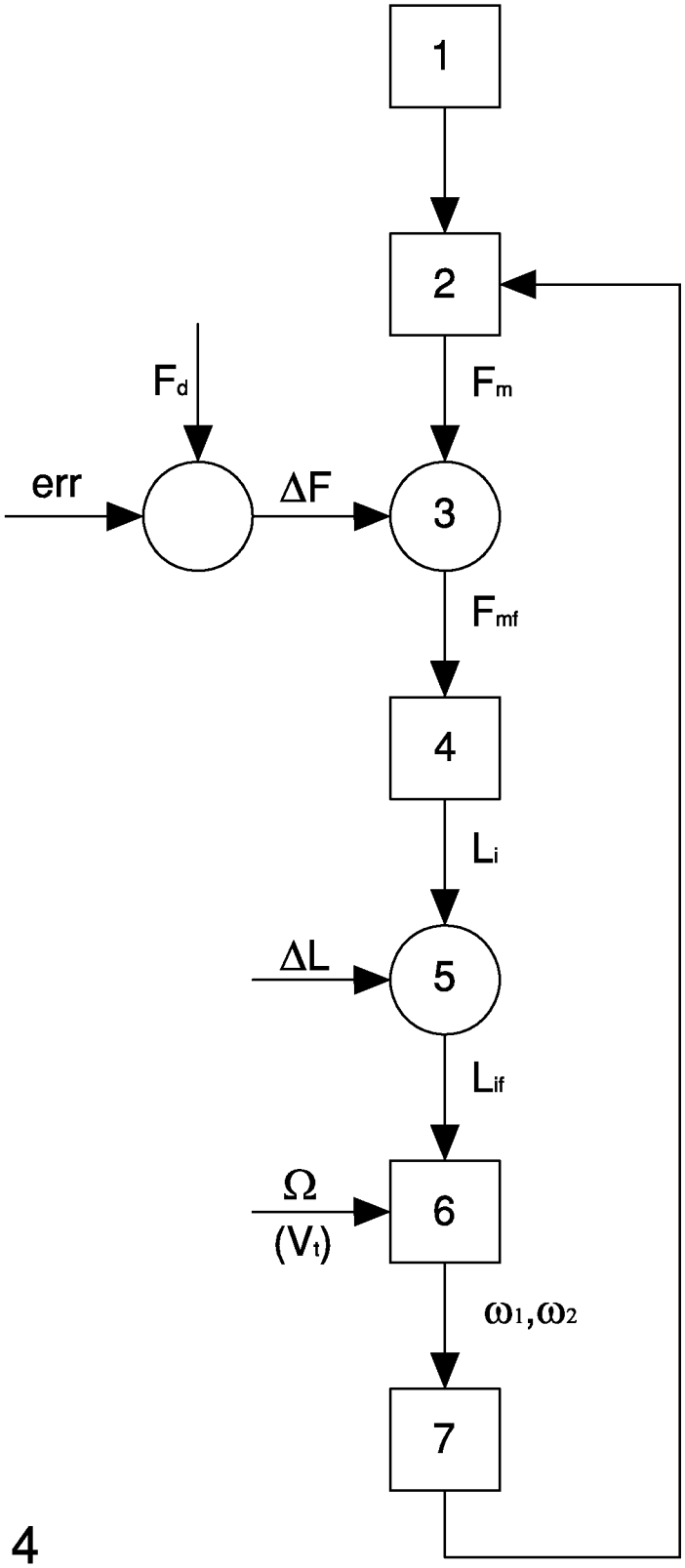
FIG. 4 is a block diagram which illustrates the method of the invention for controlling an unwinding process performed by the wrapping machine of FIG. 1.

With particular reference to the diagram of FIG. 4, the wrapping method for wrapping a load 100 with a film 50 by means of a wrapping machine 1 according to the invention provides the following steps:

- rotating the unwinding apparatus 10 and load 100, relative to one another, around a wrapping axis W with a rotation speed Ω and unwind the film 50 from the reel 51, by rotating the pre-stretching rollers 4, 5 of the unwinding apparatus 10 in order to wrap the load 100 with a series of bands of film (step 1);
- measuring an effective wrapping force $F_m$ of the film 50 by means of the force sensor 9 (step 2);
- filtering the effective wrapping force $F_m$ by means of a first filter, for example passband, with a first passband ΔF that is a function of a set wrapping force $F_d$ and an established maximum reading error err of the force sensor 9, so as to obtain a filtered wrapping force $F_{mf}$(step 3);
- calculating by means of a PID control algorithm an instant film length $L_i$ to be dispensed per rotation of the unwinding apparatus 10 or the load 100 on the basis of the filtered wrapping force $F_{mf}$ (step 4);
- filtering the instant film length $L_i$ by means of a second filter, for example a passband, with a second passband ΔL comprising a range of admissible values of the instant film length to be supplied, so as to obtain an instant filtered film length $L_{if}$ (step 5);
- calculating an instant rotation speed $\omega_1$, $\omega_2$ of at least one pre-stretching roller 4, 5 of said couple of pre-stretching rollers on the basis of the instant filtered film length $L_{if}$ and at least of said rotation speed Ω (step 6);
- rotating at least one pre-stretching roller 4, 5 of said couple of pre-stretching rollers with said instant rotation speed $\omega_1$, $\omega_2$ (step 7).

The method envisages repeating the sequence of steps from 2 to 7, which define a detection and calculation cycle, with a given frequency or given sampling interval (for example every 100 ms) during the wrapping of the load 100 so as to adjust the instant rotation speed of the pre-stretching rollers 4, 5 and hence the wrapping force in a fast and effective way.

The method further envisages, in step 1, moving the unwinding apparatus 10 along the movement direction T, parallel to the wrapping axis W, with a linear movement speed $V_t$ so as to wrap the load 100 and form a series of bands of film 50 with a helical arrangement. In the example illustrated in the figures, the unwinding apparatus 10 is fixed to the rotating ring 11 which rotates with the rotation speed Ω about the wrapping axis W and the load 100 that is static and is moved by the supporting carriage 12 along the movement direction T with the movement speed $V_t$. The method envisages determining the two instant rotation speeds $\omega_1$, $\omega_2$ of the two pre-stretching rollers 4, 5 and then rotating the latter with the defined instant rotation speeds $\omega_1$, $\omega_2$.

The established maximum reading error err is, for example, equal to ±15-35% of the set wrapping force $F_d$, the latter being selected by the operator according to the type of load 100 to be wrapped and/or the characteristics of the wrapping machine 1 and/or the plastic film 50.

The method envisages, in step 3, filtering the effective wrapping force $F_m$ so that the latter is associated with the filtered wrapping force $F_{mf}$ when it belongs to the first passband ΔF or is discarded when it does not belong to the first passband. In the latter case, the filtered wrapping force $F_{mf}$ is associated, or equal to, a lower limit value of force $F_{inf}$ or an upper limit value of force $F_{sup}$ of the first passband ΔF. More precisely, if the effective wrapping force $F_m$ is higher than the values defined by the first passband ΔF, the filtered wrapping force $F_{mf}$ is associated with the upper limit value of force $F_{sup}$ of the first passband ΔF. Vice versa, if the effective wrapping force $F_m$ is lower than the values defined by the first passband ΔF, the filtered wrapping force $F_{mf}$ is associated with the lower limit value of force $F_{inf}$ of the first passband ΔF.

The first passband ΔF comprises a range of admissible values of the wrapping force which is defined by the following formula:

$$\Delta_F = F_d \pm err \quad \text{(eq. 1)}$$

In this way, it is possible to filter the effective wrapping forces $F_m$ measured by the force sensor 9, discarding the values of the forces due to the movements and/or vibrations of the wrapping machine 1 during operation and/or due to interference in the signals of the detected forces, so as to avoid instability in controlling the wrapping.

The method envisages, in step 4, calculating an instant film length $L_i$ by the PID control algorithm of wrapping which comprises the following formula:

$$L_i = K_p * e_n + K_i \Sigma_{k=0}^{n} e_k + K_d * (e_n - e_{n-1}) \quad \text{(eq. 2)}$$

wherein:

$e_n$ is the error calculated as the difference between the filtered wrapping force $F_{mf}$ and the set wrapping force $F_d$ at the sampling instant n ($e_n=F_{mf}-F_d$);

$e_{n-1}$ is the error calculated at the previous sampling instant n−1;

$K_p$ is the proportional coefficient $K_i$ is the integral coefficient; and $K_d$ is the derivative coefficient.

The value calculated by the PID control algorithm in the sampling instant n is therefore the length or instant quantity of film $L_i$, expressed in metres and referring to a rotation of the wrapping apparatus 10 or the load 100, which must be supplied in order to bring the effective wrapping force $F_m$ to coincide with the set wrapping force $F_d$ in the next sampling instant n+1.

In fact, as it is known, compensating for an increase in the wrapping tension or force of the film, i.e. a greater demand for film by the load during the wrapping, requires supplying a greater amount (or length) of film. Vice versa, compensating for a decrease in the wrapping tension or force of the film, i.e. a reduced demand for film by the load, requires supplying a smaller amount of film. The tension and amount of film supplied per rotation are in fact correlated.

It has to be noted that the value calculated by the PID control algorithm is independent of the rotation speed Ω of the unwinding apparatus 10 (or the load 100) about the wrapping axis W or the rotation speed of the pre-stretching rollers 4, 5 taken individually, but is linked to the ratio between said rotation speed Ω and said rotation speed of the pre-stretching rollers, i.e. is linked to the ratio of the electric axis in the speed of the motors that move the unwinding apparatus and the pre-stretching rollers. In this way, the PID control algorithm makes it possible to calculate an amount of film to be dispensed to compensate for the variation in the wrapping tension or force of the film, regardless of the rotation of the pre-stretching rollers and the unwinding apparatus.

The proportional $K_p$, integral $K_i$ and derivative $K_d$ coefficients of the control algorithm are parameters calculated empirically by appropriate calibration procedures of a known type, for example with the methods of Ziegler-Nichols.

It should be noted that if the error $e_n$ in the sampling instant n is equal to zero, the value of the length or instant amount of film $L_i$, calculated by the formula eq. 2 of the PID control algorithm is given by the integral and derivative components:

$$L_i=K_i\Sigma_{k=0}^{n}e_k+K_d*(-e_{n-1}) \quad \text{(eq. 2)}$$

The method of the invention envisages, in step 5, filtering the values of the instant film length $L_i$ by the second filter having the second passband ΔL, in particular by associating the instant film length $L_i$ with the instant filtered film length $L_{if}$ when the instant film length $L_i$ belongs to the second passband ΔL or by discarding this instant film length $L_i$ when it does not belong to the second passband ΔL. In the latter case, the instant filtered film length $L_{if}$ is associated with a lower limit value of film $L_{inf}$ or to an upper limit value of film $L_{sup}$ of the second passband ΔL. More precisely, if the instant film length $L_i$ is higher than the values defined by the first passband ΔL, the instant filtered film length $L_{if}$ is associated with the upper limit value of film $L_{sup}$ of the second passband ΔL. Vice versa, if the instant film length $L_i$ is lower than the values defined by the second passband ΔF, the filtered instant film length $L_{if}$ is associated with the lower limit value of film $L_{inf}$ of the second passband ΔF. The latter includes the range of admissible values of the instant film length to be supplied and is defined by the following formula:

$$\Delta L=S_f\pm A \quad \text{(eq. 3)}$$

wherein:

$S_f$ is the initial film length per rotation of the unwinding apparatus 10 or the load 100, determined on the basis of the size and/or shape of the latter;

A is a parameter equal to a definite percentage of the initial film length.

In other words, the second passband ΔL defines the lower limit and the upper limit of the film length to unwind.

It should be noted that by setting the amplitude of this second passband ΔL, it is possible to select the work mode of the wrapping machine 1.

By reducing this interval ΔL, operation of the wrapping machine is obtained which is essentially similar to that which can be obtained by setting a substantially constant film length to be supplied. It should be noted that this length is however varied during the wrapping of the load 100 in relation to the effective values, measured in real time, of the rotation speed Ω of the rotating ring 11 and the movement speed $V_t$ of the supporting carriage 12.

This setting is advantageous when wrapping loads or products with the same size and/or of a regular shape and with high rotation speeds of the rotating ring 11.

On the contrary, increasing the amplitude of the range of admissible values of the instant film length to be supplied, i.e. from the second passband ΔL, it is possible to increasingly vary the film length supplied, as this variability in supplying the film is suitable for example when batches of loads or products have different shapes and sizes between them and/or irregular loads, for example with a narrow and elongated section.

Also in this case, by further limiting the permissible values of the lengths of film to unwrap, it is possible to filter and eliminate excessive values of lengths of film that may not be instantly supplied from the pre-stretching rollers 4, 5, thereby preventing instability in controlling the wrapping.

The method also envisages calculating the instant rotation speed $\omega_1$, $\omega_2$ of at least one of the pre-stretching rollers 4, 5 (both in the example shown), also on the basis of the movement speed $V_t$ of the unwinding apparatus 10 along the movement direction T.

The linear movement speed $V_t$ of the unwinding apparatus 10 is calculated by the formula:

$$V_t=(H_b-S_r)\cdot\omega \quad \text{(eq. 4)}$$

where:

$H_b$ is the height (mm) of said reel 51 of film;

$S_r$ is the overlapping (mm) required by the bands of film;

Ω is the rotation speed (rad/s) of the unwinding apparatus 10 or the load 100 about the wrapping axis W.

Rotating the pre-stretching rollers 4, 5 comprises, in particular, controlling and operating at least one motor 6, 7 arranged to rotate at least one respective pre-stretching roller 4, 5 with the relative instant rotation speed $\omega_1$, $\omega_2$.

The illustrated embodiment of the wrapping machine 1 envisages separately and independently controlling and operating both the first motor 6 which rotates the first pre-stretching roller 4 and the second motor 7 which rotates the second pre-stretching roller 5. Thanks to the wrapping method of the invention, it is therefore possible to control and maintain a substantially constant wrapping tension or force of the film 50 wrapped around the load 100, also for high rotation speeds Ω of the unwinding apparatus 10 or the load 100 and/or regardless of the size and shape of the load 100 and its position inside the wrapping machine 1.

Based on the effective wrapping forces $F_m$ measured in real time by the force sensor 9, associated with one of the return rollers 8 of the unwinding apparatus 10, it is in fact possible to calculate, using the PID control algorithm, an instant length $L_i$ of the film to be supplied which is independent of the rotation speed Ω of the unwinding apparatus 10 (or the load 100) and the rotation speed of the pre-stretching rollers 4, 5 taken individually, but linked to the relationship between said rotation speed Ω and said rotation speed of the pre-stretching rollers. Based on the instant film length $L_i$ thus calculated and subsequently filtered $Li_f$, with the rotation speed Ω of the unwinding apparatus 10 (or the load 100) and possibly the movement speed $V_t$ of the latter, the instant rotation speeds $\omega_1$, $\omega_2$ of the pre-stretching rollers 4, 5 are subsequently determined and the electric motors 6, 7 are suitably actuated and controlled, which cause the rotation of said pre-stretching rollers 4, 5.

In this way, with each variation in the effective wrapping force measured by the force sensor 9, and more specifically as a function of an error calculated as the difference between the filtered wrapping force $F_{mf}$ and the set wrapping force $F_d$, the control unit 16 of the wrapping machine 1 is able to vary, depending on the rotation speed Ω of the unwinding apparatus 10 (or the load 100) and possibly the movement speed $V_t$, the instant rotation speed $\omega_1$, $\omega_2$ of the pre-stretching rollers 4, 5 in order to supply the length or the required amount of film (instant filtered length $L_{if}$) so as to regain the set wrapping force $F_d$.

This feedback control is even effective for high rotation speeds, Ω as filtering the effective wrapping forces $f_m$ on the basis of the first passband ΔF (function of a set wrapping force $F_d$ and an established maximum reading error err of the force sensor 9) makes it possible to eliminate the force values detected by the force sensor 9 that are anomalous and/or not indicative because they are due to movements and/or vibrations of the wrapping machine 1 during operation and/or also due to interference in the detected force signal. This arrangement makes it possible to avoid instability in controlling the wrapping and quickly and efficiently correct the supply of the film 50 so as to maintain the wrapping force substantially constant.

It should also be noted that the stability of the control method is also ensured by filtering the instant lengths of film $L_i$ to be supplied per rotation of the unwinding apparatus 10 or the load 100 on the basis of the second passband ΔL, i.e. limiting the permissible values of the lengths of film to unwind and eliminating the values of lengths of excessive film that may not be instantly supplied from the pre-stretching rollers 4, 5.

Furthermore, it is possible to advantageously set the amplitude of the second passband ΔL to select the work mode of the wrapping machine 1. By reducing this second passband ΔL, operation of the wrapping machine 1 is obtained which is substantially similar to that which can be obtained by setting a substantially constant film length, while increasing the amplitude of the second passband ΔL makes it possible to further vary the film length supplied, in particular when batches of loads or products have different shapes and sizes from each other and/or irregular loads, for example with narrow and elongated sections.

The wrapping machine and the wrapping method of the invention therefore ensure wrapping the film around the load in a high-quality, efficient manner, regardless of the size and shape of the latter and also with high rotation speeds of the unwinding apparatus 10.

The invention claimed is:

1. A method for wrapping a load with a film by means of a wrapping machine provided with an unwinding apparatus that comprises a reel of film, a plurality of pre-stretching rollers for unwinding and stretching the film, at least one return roller arranged to divert the film toward the load and at least one force sensor associated with the return roller and arranged to measure a wrapping force of the film that is engaged with the return roller and wrapping around the load, the method comprising the following steps:

Step 1, rotating the unwinding apparatus and the load relative to one another around a wrapping axis with a rotation speed and unwinding the film from the reel by rotating the pre-stretching rollers in order to wrap the load with a series of bands of the film;

Step 2, measuring an effective wrapping force of the film by means of the force sensor;

Step 3, filtering the effective wrapping force by means of a first filter with a first passband that is a function of a set wrapping force and an established maximum reading error of the force sensor, so as to obtain a filtered wrapping force;

Step 4, calculating by means of a PID control algorithm an instant film length to be supplied per rotation of the unwinding apparatus or the load based on the filtered wrapping force;

Step, 5 filtering the instant film length by means of a second filter with a second passband that comprises a range of admissible values of the instant film length to be supplied;

Step 6, calculating an instant rotation speed of at least one pre-stretching roller of the plurality of pre-stretching rollers based on the filtered instant film length and at least the rotation speed; and Step 7, rotating the at least one pre-stretching roller of the plurality of pre-stretching rollers about one respective longitudinal axis with the instant rotation speed, wherein said filtering of the effective wrapping force comprises associating the effective wrapping force to the filtered wrapping force, when the effective wrapping force belongs to the first passband, or discarding the effective wrapping force and associating the filtered wrapping force to a lower limit value of force or an upper limit value of force of the first passband, when the effective wrapping force does not belong to the first passband, and wherein the first passband comprises a range of admissible values of wrapping force between the lower limit value of force and the upper limit value of force and defined by the formula:

$$\Delta_F = F_d \pm err$$

where:

$\Delta_F$ is the first passband;

$F_d$ is the set wrapping force; and err is the established maximum reading error.

2. The method according to claim 1, further comprising repeating steps from 2 to 7 in sequence with a given frequency or a given sampling interval during the wrapping of the load, wherein the sequence of steps from 2 to 7 define a detection and calculation cycle.

3. The method according to claim 1, wherein the established maximum reading error is equal to ±15-35% of the set wrapping force.

4. The method according to claim 1, wherein the PID control algorithm includes the formula:

$$L_i = K_p * e_n + K_i \Sigma_{k=0}^{n} e_k + K_d * (e_n - e_{n-1})$$

where:

$L_i$ is the instant film length;

$e_n$ is an error calculated as a difference between the filtered wrapping force and the set wrapping force at a sampling instant n;

$e_{n-1}$ is an error calculated at a previous sampling instant n−1;

$K_p$ is a proportional coefficient;

$K_i$ is an integral coefficient; and $K_d$ is a derivative coefficient.

5. The method according to claim 1, wherein said filtering of the instant film length comprises associating the instant film length to the filtered instant film length, when the instant film length belongs to the second passband, or discarding the instant film length and associating the filtered instant film length to a lower limit value of film or an upper limit value of film of the second passband, when the instant film length does not belong to the second passband, and wherein the second passband comprises a range of admissible values of instant film length to be supplied between the lower limit value of film and the upper limit value of film and defined by the formula:

$$\Delta L_f = S_f \pm A$$

where:

$\Delta L_f$ is the second passband;

$S_f$ is an initial film length per rotation of the unwinding apparatus or the load, calculated according to at least one of size and shape of the load; and A is a parameter equal to a definite percentage of the initial film length.

6. The method according to claim 1, further comprising moving the unwinding apparatus parallel to the wrapping axis, with a linear movement speed so as to wrap the load and form a series of bands of the film with a helical arrangement.

7. The method according to claim 6, wherein said calculating of the instant rotation speed further comprises calculating the instant rotation speed of the at least one pre-stretching roller of the plurality of pre-stretching rollers based also on the linear movement speed of the unwinding apparatus.

8. The method according to claim 7, wherein the linear movement speed of the unwinding apparatus is calculated using the formula:

$$V_t = (H_b - S_r) \cdot \Omega$$

where:

$V_t$ is the linear movement speed;

$H_b$ is a height in millimetres of the reel of film;

$S_r$ is an overlapping in millimetres required by the bands of the film; and

Ω is the rotation speed in radians/second of relative rotation of the unwinding apparatus and the load with respect to one another.

9. The method according to claim 6, wherein the linear movement speed of the unwinding apparatus is calculated using the formula:

$$V_t = (H_b - S_r) \cdot \Omega$$

where:

$V_t$ is the linear movement speed;

$H_b$ is a height in millimetres of the reel of film;

$S_r$ is an overlapping in millimetres required by the bands of the film; and

Ω is the rotation speed in radians/second of relative rotation of the unwinding apparatus and the load with respect to one another.

10. The method according to claim 1, wherein said rotating of the at least one pre-stretching roller comprises controlling and actuating at least one motor arranged to rotate the at least one pre-stretching roller with the instant rotation speed.

11. A wrapping machine for wrapping a load with a film, the wrapping machine comprising:

an unwinding apparatus that comprises a reel of film;

a plurality of pre-stretching rollers for unwinding and stretching the film;

at least one return roller arranged to divert the film toward the load; and at least one force sensor associated with said return roller and arranged to measure a wrapping force of the film that is engaged with said return roller and wrapping around the load, wherein the wrapping machine is arranged to operate according to the method of claim 1.

12. The wrapping machine according to claim 11, further comprising a transmission module for wirelessly transmitting data, mounted on said unwinding apparatus and connected to said force sensor to receive from said force sensor signals related to the effective wrapping forces and send them to a receiving module of a control unit, wherein the control unit is arranged to manage and control the operation of the wrapping machine.

13. The wrapping machine according to claim 12, further comprising a driving module, connected to and controlled by said control unit and arranged for actuating and controlling at least one motor adapted to rotate said pre-stretching rollers.

* * * * *